US009415482B2

(12) United States Patent
Jespersen

(10) Patent No.: US 9,415,482 B2
(45) Date of Patent: Aug. 16, 2016

(54) ADAPTER PROFILE FOR A GRINDING TOOL

(76) Inventor: Poul Erik Jespersen, Roslev (DK)

( * ) Notice: Subject to any disclaimer, the term of this patent is extended or adjusted under 35 U.S.C. 154(b) by 775 days.

(21) Appl. No.: 13/321,175

(22) PCT Filed: May 18, 2010

(86) PCT No.: PCT/DK2010/050108

§ 371 (c)(1),
(2), (4) Date: Nov. 30, 2011

(87) PCT Pub. No.: WO2010/133229

PCT Pub. Date: Nov. 25, 2010

(65) Prior Publication Data

US 2012/0064811 A1 Mar. 15, 2012

(30) Foreign Application Priority Data

May 18, 2009 (DK) ..... 2009 00625

(51) Int. Cl.
*B24B 33/00* (2006.01)
*B24D 13/06* (2006.01)
*B24D 9/04* (2006.01)

(52) U.S. Cl.
CPC . *B24D 13/06* (2013.01); *B24D 9/04* (2013.01)

(58) Field of Classification Search
CPC ..... B24D 13/06; B24D 13/10; B24D 9/04; A46B 13/005
USPC ..... 451/469, 466, 490, 496; 15/183, 230.19
See application file for complete search history.

(56) References Cited

U.S. PATENT DOCUMENTS

| | | | | | |
|---|---|---|---|---|---|
| 2,450,679 | A | | 10/1948 | May | |
| 2,767,418 | A | * | 10/1956 | Lombardi | 15/183 |
| 3,058,269 | A | * | 10/1962 | Block | 451/469 |
| 3,678,633 | A | * | 7/1972 | Block | 451/469 |
| 4,498,210 | A | * | 2/1985 | Drumm | 15/183 |
| 4,835,913 | A | * | 6/1989 | Blanton | 451/468 |
| 4,882,879 | A | * | 11/1989 | Warner et al. | 451/469 |
| 5,045,091 | A | * | 9/1991 | Abrahamson et al. | 51/293 |
| 5,358,311 | A | * | 10/1994 | Drumm | 300/21 |
| 5,400,458 | A | * | 3/1995 | Rambosek | 15/179 |
| 5,445,438 | A | * | 8/1995 | Drumm | 300/21 |

(Continued)

FOREIGN PATENT DOCUMENTS

| | | |
|---|---|---|
| DE | 102004004405 A1 | 8/2005 |
| WO | 0176824 | 10/2001 |

(Continued)

*Primary Examiner* — Joseph J Hail
*Assistant Examiner* — Marc Carlson
(74) *Attorney, Agent, or Firm* — James Creighton Wray; Meera P. Narasimhan

(57) ABSTRACT

A grinding tool has a grinding head (1) that includes one or more surfaces with a number of recesses (2). Fastenings are provided in one or more recesses (2) for fixing tool members (5). The fastenings are adapter strips (6) disposed in one or more of the recesses (2). The adapter strips (6) are provided with at least one internal and preferably longitudinal recess (7). The recess (7) in the adapter strip (6) has sidewalls (8). Retainer parts (9) of the tool members have complementing outer sidewalls and are mounted in these adapter strips (6). The grinding tool with a universal grinding head (1) uses all types of tool members (5) in one and the same grinding head (1). It is thus possible to change between tool members (5) with different shapes on the retainer part (9) by switching between different adapter strips (6).

18 Claims, 2 Drawing Sheets

(56) References Cited

U.S. PATENT DOCUMENTS

| | | | | |
|---|---|---|---|---|
| 5,606,762 | A * | 3/1997 | Droeser et al. | 15/193 |
| 5,762,404 | A * | 6/1998 | Drumm | 300/21 |
| 6,217,124 | B1 * | 4/2001 | Jespersen | 300/21 |
| 6,217,431 | B1 * | 4/2001 | Brinkmann | 451/464 |
| 6,267,660 | B1 * | 7/2001 | Jespersen | 451/550 |
| 6,592,442 | B2 * | 7/2003 | Hoffheimer | 451/466 |
| 6,793,569 | B2 * | 9/2004 | Lundum | 451/490 |
| 6,869,349 | B2 * | 3/2005 | Lundum | 451/490 |
| 7,056,201 | B2 * | 6/2006 | Jespersen | 451/465 |
| 7,169,027 | B2 * | 1/2007 | Jespersen | 451/466 |
| 7,485,030 | B2 * | 2/2009 | Jespersen | 451/496 |
| 7,806,752 | B2 * | 10/2010 | Jespersen | 451/496 |
| 7,988,540 | B2 * | 8/2011 | Himmer | 451/469 |
| 2002/0086631 | A1 * | 7/2002 | Hoffheimer | 451/466 |

FOREIGN PATENT DOCUMENTS

| | | |
|---|---|---|
| WO | 2004103643 | 12/2004 |
| WO | 2007009466 | 1/2007 |

* cited by examiner

ADAPTER PROFILE FOR A GRINDING TOOL

This application claims the benefit of Danish Application No. PA 2009 00625 filed May 18, 2009 and PCT/DK2010/050108 filed May 18, 2010, which are hereby incorporated by reference in their entirety as if fully set forth herein.

FIELD OF APPLICATION OF THE INVENTION

The present invention concerns a grinding tool including a grinding head including one or more surfaces with a number of recesses where in one or more of these recesses fastening means are fitted for fixing tool members of abrasive paper, brushes, support brushes and/or retainer brushes, where the tool members are provided with a securing part, where the recesses in the grinding head is designed with sidewalls, and where the securing means are designed with complementing outer sidewalls. Furthermore, the invention concerns an adapter strip and use of such a strip.

BACKGROUND OF THE INVENTION

By surface treatment, as e.g. sanding or polishing, of various items, it is known to use grinding and polishing members which are mounted on a grinding head. Such a grinding head may be designed with a cylindric drum on which the grinding members are mounted at the surface of the drum. Other types of grinding heads may be disc-shaped or built up as a combination of disc-shaped and cylindric parts. The design is typically made in relation to which items that are to be worked. However, it is typical of these grinding heads that they are provided with a kind of dovetail grooves in which a number of abrasive and/or brush members are mounted. These members may include abrasive paper, brushes of fibre, hair, steel or other metals and combinations of these, e.g. in the form of retainer brushes that support the abrasive paper during use. The abrasive paper can e.g. be sandpaper for buffing wood, metal and the like, canvas and/or fabric polishing, or leather. Brushes, support brushes and/or retainer brushes may e.g. be steel brushes, plastic brushes or other types of brushes.

In the following, these members are designated by a common term as tool members.

Such tool members can be made of a plastic material, in which abrasive paper and brushes are embedded by moulding a plastic member around abrasive paper and brush. Alternatively, brushes and/or abrasive paper can be fixed in a metal rail by squeezing the latter around the brushes and/or the abrasive paper of which the tool member in question is to be made, or in other suitable ways.

On a typical grinding head are arranged as an average between 30 and 60 tool members which are to be replaced regularly by industrial use. Such a replacement may typically occur in two ways. Either by replacing the entire grinding head with a "fresh" corresponding grinding head, or by replacing individual tool members one by one by pulling them out of the dovetail grooves in which they are mounted and substitute them with new tool members. The choice of which methods to be used somehow depends on whether there is time for performing the required exchange of the individual tool members, or whether it is about keeping a production running since it then may be more expedient to replace the entire grinding head and subsequently prepare the worn grinding head.

Different types of grinding heads with different types of dovetail grooves are on the market. For each of these grinding heads are then provided different types of tool members, including brushes and abrasive members as mentioned above.

The drawback of the different types of grinding head, and for that matter also of the different types of tool members for use in these grinding heads, is that the different tool members do not fit all types of grinding heads. The customer is therefore often bound to buy tool members from the same supplier who has supplied the grinding head, which obviously contributes to keeping the price of consumables like tool members at a high level.

From WO 01/76824 is known a grinding member for mounting in a recess in a peripheral surface on a grinding head. The abrasive member includes a securing means with a groove in which abrasive paper, support brushes and/or retainer brushes can be fitted. The base part of the grinding member has inclining sidewalls that fit a corresponding groove in the surface of the grinding head. The disadvantage of this abrasive element and of many others is that they only fit in a grinding head made particularly for these grinding elements, and vice versa, which obviously can be a source of annoyance as not all providers of such equipment have all the different types of tool members in their product program. Therefore, it is often necessary to acquire many different types of grinding heads in order to perform different tasks, obviously entailing increased use of time for setup on the respective machines on which the grinding head is used and also a greater investment in grinding heads.

From WO 2007/009466 is known a grinding tool containing a cylindric drum provided with undercut grooves in which profiled strips are arranged. The profiled strips comprise a bottom strip designed for replaceable accommodation of a bottom profile arranged with a number of brushes and abrasive elements. It is a drawback that the grinding tool is adapted such that only a specifically designed profiled strip fits the grinding tool. It is not possible for a user to apply grinding tools from one supplier and tool members from another supplier. The user is bound by the assortment that is available at the individual suppliers.

PURPOSE OF THE INVENTION

It is thus the purpose of the present invention to indicate a solution by which different types of tool members can be used on different types of grinding heads, and vice versa, where the tool members are easy to replace.

DESCRIPTION OF THE INVENTION

As mentioned in the introduction, the present invention concerns a grinding tool including a grinding head that includes one or more surfaces with a number of recesses, where fastening means are provided in one or more these recesses for fixing tool members. The new features of a grinding head according to the invention are that the fastening means are constituted by adapter strips, the adapter strips disposed in one or more of the recesses in the grinding head, and where the adapter strips are provided with at least one internal and preferably longitudinal recess, where the recess in the adapter strip is designed with sidewalls, and where the retainer parts of the tool members are designed with complementing outer sidewalls and are mounted in these adapter strips.

By using such a grinding head that e.g. can be a universal grinding head where the said recesses are with a size and shape greater than those of traditional grinding heads, where adapter strips are applied in the recesses, it is possible to use all different kinds of tool members in one and the same grinding head. The only required condition is to use adapter strips with different internal recesses adapted to respective tool members. It is thus possible to change between tool members with different shape on the retainer part by switching between different adapter strips. These adapter strips may advantageously be permanently mounted on the tool members such that all tool members immediately can be mounted in the grinding head.

A particular embodiment of a grinding tool according to the invention is where the recesses in the surface of the grinding head have inclining sidewalls and that the adapter strips have complementing outer sidewalls with inclination. It is thus a relatively simple shape of the recess which has been tested in the prior art grinding heads where the tool member is mounted directly in the recess. This shape furthermore ensures secure locking of the tool member.

In yet a variant of a grinding tool according to the invention, adapter strips may be mounted in the recesses in the surface of the grinding head, and more than one tool member may be mounted in one or more specific adapter strips. It is thus possible to mount e.g. a replaceable abrasive strip and a replaceable support brush in one and the same adapter strip. This may occur by interconnecting the two tool members and pushing them into one recess in the adapter strip; however, recesses may be provided in the adapter strip for more than one tool member as well.

An adapter strip for a grinding tool according to the invention may advantageously be made in plastic or aluminium. A material thickness of a few millimeters will typically be completely sufficient, and a relatively slender profile is thus provided. An adapter strip may e.g. be with a width of about 15 mm and with a height of about 10 mm. The sides corresponding to the sidewalls in the recesses in the grinding head may e.g. be with an angle of 15° such that the adapter strip is most narrow at the edge in which there is one or more recesses for tool members. The internal recess in the adapter strip is adapted to the various tool members.

In an embodiment of an adapter strip according to the invention, it is made with a long length for individual adaptation to a specific grinding head. It is thus possible for the user to shorten adapter strips to precisely the lengths that are to be used in the grinding head in question. Alternatively, the adapter strip may of course be made to a specific length for use in a specific grinding head delivered to the user in this way.

A particularly preferred variant of an adapter strip according to the invention is where the adapter strip is made with an outer profile corresponding to the inner profile in recesses in a standard grinding head. It is thus possible to use an already purchased grinding head with grinding tools that originally were intended for other types of grinding heads. Hereby may be achieved the obvious advantage that not so many different grinding heads are to be purchased from different suppliers.

An adapter strip as mentioned above may advantageously be used in a grinding head where the grinding head is adapted to be used with tool members with a given profile on the retainer part corresponding to recesses in the grinding head. For example, use of an adapter strip according to the invention may occur in that the adapter strip is used in one or more recesses in a grinding head combined with tool members with retainer parts that correspond to the inner recess in the adapter strip, whereas tool members with retainer parts corresponding to recesses in the grinding head are used in one or more other recesses. In this way it is possible to equip a grinding head with tool members that are particularly made for the type of grinding head in question together with tool members for other types, or which are provided with a universal retainer part.

Such a universal retainer part may be shaped in innumerable ways, and it will be obvious for the skilled in the art to choose a suitable shape.

However, it is clear that the invention in particular implies a markedly enhanced freedom to compose grinding heads and tool members, mixing different types and brands, whereby an appreciable and much-wanted degree of freedom is achieved.

SHORT DESCRIPTION OF THE FIGURES

The invention is explained more closely in the following with reference to the drawings, where:

DETAILED DESCRIPTION OF EMBODIMENTS OF THE INVENTION

Figure 1:
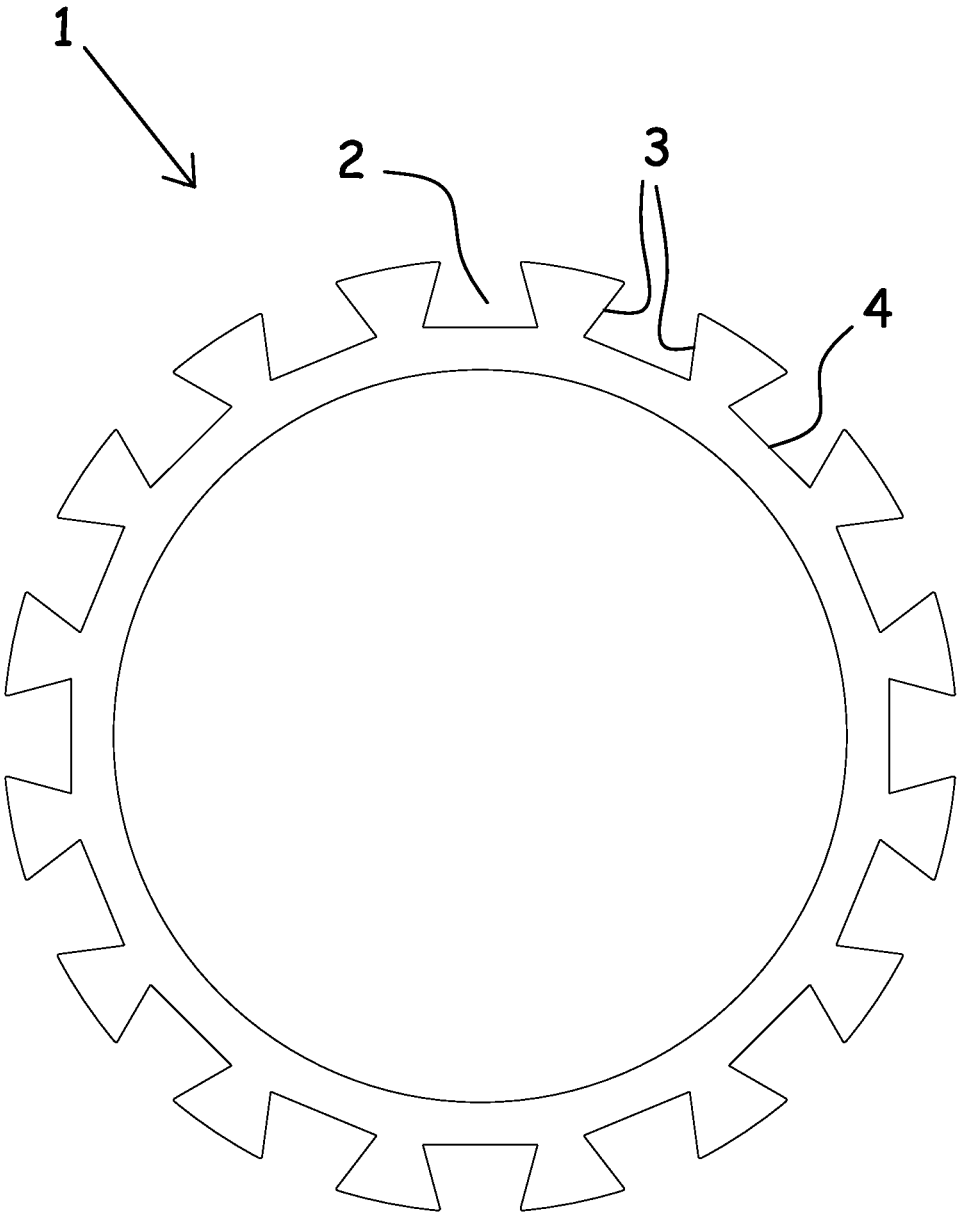
FIG. 1 shows a grinding head with recesses without tool members.

On FIG. 1 is shown a grinding head 1, here shown from the end and with a cylindric cross-section, where sixteen identical recesses 2 with inclining sidewalls 3 and with a plane bottom 4 are formed in the surface. The shown recesses 2 are rectilinear, but may also be convoluted along the periphery of the cylindric grinding head 1. The grinding head 1, as shown in this Figure, can be fitted with tool members 5 directly into the shown recesses 2, but may also be used with tool members 5 which are mounted via an adapter strip 6.

Figure 2:
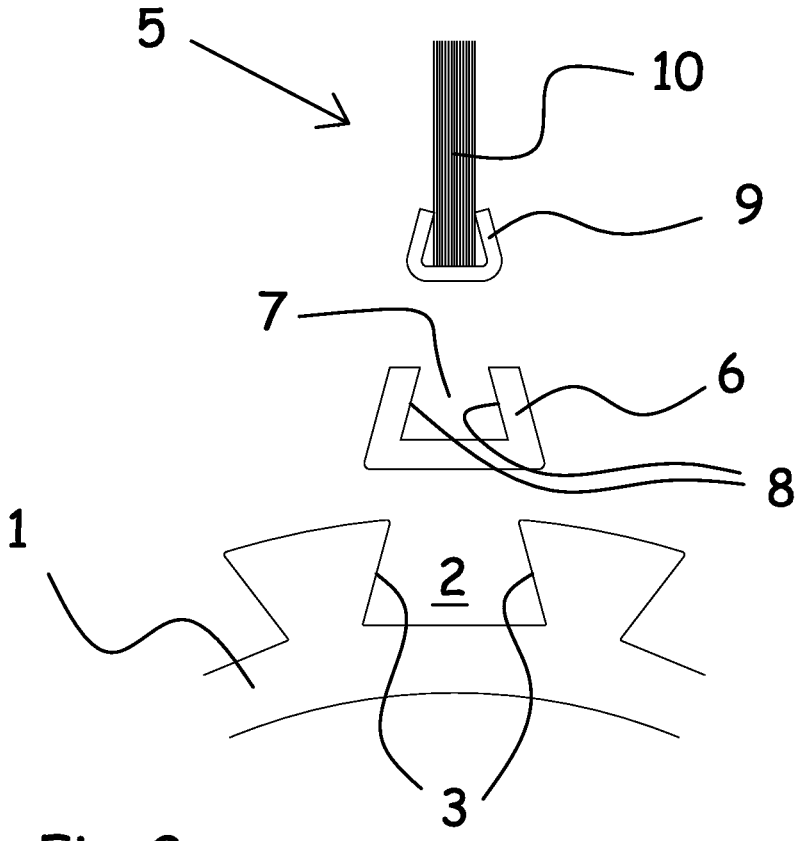
FIG. 2 shows a detail of a grinding head, an adapter strip and a tool member.

In FIG. 2 appears a detail of a grinding head 1 with a recess 2. Moreover, immediately over the recess 2 is seen an example of an adapter strip 6 which is adapted to the recess 2 in the grinding head 1. Internally of the adapter strip 6, an additional recess 7 is provided which may have innumerable shapes, but which is shown here with conical straight faces 8 which is principle correspond to the recesses 2 in the grinding head 1. The adapter strip 6 can be made of plastic or metal and may be provided with a uniform or varying material thickness, depending on the shape of respective recesses. Above the adapter strip 6 appears an example of a tool member 5 which is here represented by a brush member. The shown tool member 5 is with a retainer part 9 and with brushes 10. The retainer part 9 can be made in different ways, but is here illustrated as a metal rail squeezed around the brushes 10. For other types of tool members 5, the retainer part 9 may advantageously be moulded in plastic around the actual tool 10.

Figure 3:
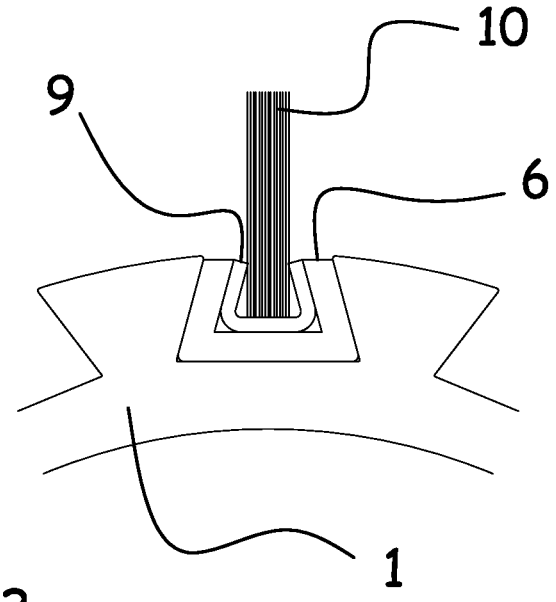
FIG. 3 shows the same as seen in FIG. 2, however here in mounted condition.

In FIG. 3, the mentioned parts in FIG. 2 are fitted in respective recesses 2, 7 in the adapter strip 6 and in the grinding head 1, respectively.

The invention claimed is:

1. A grinding tool comprising:

a grinding head (1) including one or more outer surfaces and including at least one recess (2) formed by opposite spaced inclining sidewalls (3) and a bottom (4), at least one adapter strip (6) comprising a strip base wall including a strip base inner side and a strip base outer side, first and second opposite spaced strip walls projecting therefrom forming spaced opposite inner strip sides (8) and outer strip sides and at least one strip recess (7) bounded by the spaced opposite inner strip sides (8) and the strip base inner side of the adapter strip (6), wherein the strip walls are disposed at least partially in the at least one recess (2) in the grinding head (1), and the outer strip sides having an inclining outer strip shape to complement with a shape of the opposite spaced inclining sidewalls (3) of the at least one recess (2) on the grinding head (1) and the strip base outer side shaped to complement with the bottom of the at least one recess in the grinding head, wherein the at least one strip recess in the adapter strip (6) is at least partially positioned within the at least one recess (2) in the grinding head (1), at least one retainer part (9) comprising a retainer base including a retainer base inner side and a retainer base outer side, first and second spaced retainer walls projecting therefrom forming spaced opposite inner retainer sides spaced oppositely at a lateral distance and opposite outer retainer sides and at least one retainer recess bounded by the spaced opposite inner retainer sides and the retainer base inner side of the retainer part (9), the at least one retainer recess having a longitudinal distance greater than the lateral distance, the outer retainer sides having a shape to complement with an inner strip shape of the inner strip sides (8) of the adapter strip (6) for mounting within the at least one strip recess (7) of the at least one adapter strip (6) and disposed at least partially within the at least one recess (2) in the grinding head (1), and at least one tool member (5) comprising at least one of abrasive paper, brushes, support brushes and/or retainer brushes (10), wherein the at least one tool member (5) includes a securing portion and a grinding portion, wherein the securing portion is disposed at least partially within the at least one retainer recess and at least partially disposed within the at least one recess (2) in the grinding head (1) and the grinding portion extends outward from the securing portion and outward from the outer surface of the grinding head (1).

2. Grinding tool according to claim 1, wherein the at least one adapter strip (6) includes plural adapter strips mounted in the at least one recess (2) of the grinding head, and the at least one tool member includes more than one tool member (5) mounted in one or more specific adapter strips of the plural adapter strips (6).

3. Grinding tool according to claim 2, wherein the adapter strips (6) are made of plastic or aluminium.

4. Grinding tool (6) according to claim 3, wherein the adapter strips (6) are made in long lengths for individual adaptation to a specific grinding head (1).

5. Grinding tool (6) according to claim 3, wherein each adapter strip (6) is made in a specific length for use in a specific grinding head (1).

6. Grinding tool according to claim 3, wherein each adapter strip (6) is made with an outer profile corresponding to the inner profile in recesses (2) in a standard grinding head (1).

7. Method using the grinding tool (6) according to claim 3, further comprising using the adapter strips (6) in the grinding head (1) where the grinding head (1) is adapted to be used with the tool members (5) with a given profile on the retainer part (9) corresponding to recesses (2) in the grinding head (1).

8. Method using the grinding tool (6) according to claim 7, further comprising using the adapter strips (6) in one or more recesses in the grinding head (1) combined with the tool members (5) with retainer parts (9) that correspond to the at least one internal recess (7) in the adapter strip (6), whereas tool members (5) with retainer parts (9) corresponding to recesses (2) in the grinding head (1) are used in one or more other recesses (2).

9. An adapter strip (6) for a grinding tool comprising:

one or more adapter strips (6) for a grinding head (1) including one or more surfaces with one or more recesses (2), the one or more adapter strips fitted within the one or more recesses (2) of the grinding head (1) for fixing one or more tool members (5) selected from abrasive paper, brushes, support brushes and/or retainer brushes (10), wherein each of the recesses (2) in the grinding head (1) comprises opposite spaced inclining sidewalls (3) and a bottom (4), each adapter strip (6) comprising a strip base wall including a strip base inner side and a strip base outer side, first and second opposite spaced strip walls projecting therefrom forming spaced opposite inner strip sides (8) and outer strip sides and at least one strip recess (7) bounded by the spaced opposite inner strip sides (8) and the strip base inner side of the adapter strip (6), wherein the outer strip walls are disposed at least partially in the one or more recesses (2) in the grinding head (1) and the outer strip sides have an inclining shape complementing a shape of the inclining sidewalls and the bottom of the recess in the grinding head (1), and wherein the strip recess in the adapter strips (6) is positioned within the recess in the grinding head (1), one or more retainer parts (9) for receiving the one or more tool members, each retainer part comprising a retainer bottom wall having a retainer bottom inner side and retainer bottom outer side, spaced opposite retainer walls projecting therefrom forming spaced inner retainer sides oppositely spaced at a lateral distance and opposite outer retainer sides, the retainer outer sides having a shape complementing with a shape of the inner strip sides (8) of the adapter strip (6) and mounted within the strip recess of the adapter strips (6), a retainer recess bounded by the spaced inner retainer sides and the retainer bottom inner side, the retainer recess having a longitudinal distance greater than the lateral distance, and wherein the one or more tool members (5) include a securing portion disposed at least partially within the retainer recess in the one or more retainer parts, and the retainer parts are disposed at least partially within the one or more adapter strips within the one or more recesses (2) in the grinding head.

10. An adapter strip according to claim 9, wherein adapter strips (6) are mounted in the recesses (2) in the surface of the grinding head, and that more than one tool member (5) is mounted in one or more specific adapter strips (6).

11. An adapter strip (6) for a grinding tool according to claim 9, wherein the adapter strip (6) is made of plastic or aluminium.

12. Adapter strip (6) according to claim 11, wherein the adapter strip (6) is made in a long length for individual adaptation to a specific grinding head (1).

13. Adapter strip (6) according to claim 11, wherein the adapter strip (6) is made in a specific length for use in a specific grinding head (1).

14. Adapter strip according to claim 11, wherein the adapter strip (6) is made with an outer profile corresponding to the inner profile in recesses (2) in a standard grinding head (1).

15. A grinding tool apparatus including a grinding head comprising at least one surface including at least one recess, at least one tool member removably receivable in the at least one recess, at least one fastener removably receivable in the at least one recess for fastening the at least one tool member on the grinding head, a retainer on the at least one tool member removably disposable in the at least one fastener, the at least one recess comprising a recess base wall and first and second opposite spaced recess sidewalls on the grinding head, the at least one fastener comprising an adapter strip disposable in the at least one recess, the adapter strip comprising a strip base wall having strip base inner side and strip base outer side and first and second opposite spaced strip walls forming spaced inner strip sides and outer strip sides and at least one strip recess bounded by the spaced opposite inner strip sides and a base inner side of the adapter strip, the outer strip sides and the strip base outer side of the adapter strip having a shape complementing a shape of the recess side walls and recess base wall for at least partially mounting the at least one adapter strip within the first and second opposite spaced recess sidewalls and the recess base wall of the at least one recess respectively, the retainer comprising a retainer base having retainer base inner side and retainer base outer side and first and second opposite spaced retainer walls extending therefrom forming spaced inner retainer sides oppositely spaced at a lateral distance and outer retainer sides and at least one retainer recess bounded by the spaced inner retainer sides and the retainer base inner side, the retainer recess having a longitudinal distance greater than the lateral distance, the outer retainer sides having a shape complementing a shape of the inner strip sides for mounting the retainer at least partially in the strip recess in adapter strip, the at least one tool member including a securing portion disposed at least partially in the retainer recess between the retainer base inner side, and the spaced inner retainer walls, and the outer retainer sides of the retainer engaging the inner strip side of the adapter strip for removably receiving the at least one tool member in the retainer recess and fastening the at least one tool member in the adapter strip removably disposable in the at least one recess on the grinding head.

16. The apparatus of claim 15, wherein the strip recess in the adapter strip is longitudinal.

17. The apparatus of claim 15, wherein the at least one tool member is selected from abrasive paper, brushes, support brushes, retainer brushes, and combinations thereof.

18. The apparatus of claim 15, wherein the at least one surface on the grinding head is an outer surface, the at least one recess comprises a plurality of recesses on the grinding head, the at least one adapter strip comprises a plurality of adapter strips, the at least one retainer is a plurality of retainers, the at least one tool member is a plurality of tool members, and wherein an outer profile of each of the plurality of adapter strips compliments an inner profile of a corresponding recess for at least partially receiving and holding a respective adapter strip therein, an outer profile of each of the retainers compliments an inner profile of a corresponding adapter strip for at least partially receiving and holding a respective retainer therein, and an inner profile of each retainer corresponds to an outer profile of a securing portion of a respective tool member for receiving and holding therein.

* * * * *